US006395107B1

(12) United States Patent
Subramanian

(10) Patent No.: US 6,395,107 B1
(45) Date of Patent: May 28, 2002

(54) CAST IRON FOR USE IN HIGH SPEED MACHINING WITH CUBIC BORON NITRIDE AND SILICON NITRIDE TOOLS

(76) Inventor: Sundaresa V. Subramanian, 84 Bowman Street, Hamilton, Ontario (CA), L8S 2T6

( * ) Notice: Subject to any disclaimer, the term of this patent is extended or adjusted under 35 U.S.C. 154(b) by 0 days.

(21) Appl. No.: 09/494,100

(22) Filed: Jan. 28, 2000

(51) Int. Cl.[7] ..... C22C 37/10
(52) U.S. Cl. ..... 148/321; 420/13
(58) Field of Search ..... 148/538, 540, 148/543, 545, 612, 321; 420/8, 9, 13, 29, 32

(56) References Cited

U.S. PATENT DOCUMENTS

| | | | | |
|---|---|---|---|---|
| 4,121,925 | A | * | 10/1978 | Chapman et al. |
| 4,292,075 | A | | 9/1981 | Wolfsgruber et al. |
| 4,401,469 | A | * | 8/1983 | Rehder |
| 5,580,401 | A | * | 12/1996 | Williamson |

FOREIGN PATENT DOCUMENTS

| | | | |
|---|---|---|---|
| EP | 0 272 788 | A1 | 6/1988 |
| EP | 0 616 040 | A1 | 9/1994 |
| EP | 0 675 210 | A1 | 10/1995 |
| WO | WO 00/01860 | A | 1/2000 |

OTHER PUBLICATIONS

M. S. Deming, B. A. Young and David A. Ratliff: "Turning gray cast iron with PCBN cutting tools", Diamond & CBN Ultrahard Materials Symposium '93, Industrial Diamond Associateion, Sep. 29–30, 1993, Windsor, Ontario Canada, pp. 3–11.

S. V. Subramanian, H. O. Gekonde, X. Zhang and J. Gao: "Inclusion engineering of steels for high speed machining", CIM bulletin, vol. 91, No. 1021, Jun. (1998) pp. 107–114.

H. O. Gekonde and S. V. Subramanian: "Tool wears and surface finish in high speed machining of steel", 39th MWSP Conf. Proc. ISS, vol. XXXV, 1998, pp. 773–747.

International Search Report of counterpart PCT application No. PCT/IB01/00023 mailed Apr. 18, 2001.

* cited by examiner

*Primary Examiner*—Roy King
*Assistant Examiner*—Harry D. Williams, III
(74) *Attorney, Agent, or Firm*—Cummings & Lockwood

(57) ABSTRACT

Processes for producing gray cast iron and the resulting gray cast iron exhibiting consistently good surface finish with prolonged tool life during finish machining with cubic boron nitride and silicon nitride cutting tools at high cutting speeds and low feed rates are provided comprising (1) adding microalloying elements with strong affinity for nitrogen to a gray iron melt; (2) adding microalloying elements with strong affinity for carbon to said melt; and (3) adding microalloying elements with strong affinity for oxygen to said melt, to form a chemically stable, high melting or refractory oxide protective layer at the cutting edge of the tool during metal cutting, thereby suppressing chemical wear.

10 Claims, 7 Drawing Sheets

CAST IRON FOR USE IN HIGH SPEED MACHINING WITH CUBIC BORON NITRIDE AND SILICON NITRIDE TOOLS

FIELD OF THE INVENTION

This invention relates to improved gray cast iron and to processes for producing gray cast iron comprising adding microalloying additions of elements with strong affinity for nitrogen, carbon and oxygen to the iron to obtain cast iron that suppresses chemical wear at the cutting edge of cubic boron nitride and silicon nitride cutting tools used during finish machining at high speed and low feed rates.

BACKGROUND OF THE INVENTION

High speed machining of cast iron has generated great technological interest because it has the potential to offer excellent surface finish under dry machining conditions, increase productivity and decrease cost. In finish turning operations, high speed coupled with low feed rates have been used successfully to achieve excellent surface finish so that a subsequent finish grinding operation is eliminated, resulting in substantial cost savings. Polycrystalline cubic boron nitride (PCBN) tools have been found to be the tools of choice for high speed machining because they exhibit diamond-like structure, high hardness and good thermal conductivity. For example, polycrystalline cubic boron nitride tools are successfully used at high speeds (>7,200 feet (2,194 m) per minute) and low feed rates (0.006" (0.15 mm) per revolution) to achieve the excellent surface finish (Ra<1 micrometer) as required, for example, in cast iron brake rotors. The problem, however, which has plagued the growth of high speed machining of cast iron, is the chemical wear of the tool occurring at the cutting edge caused by unknown variables in pearlitic iron casting which cause unpredictable tool life and poor surface finish. Attempts have heretofore been made to enhance the strength of the tool by increasing the cubic boron nitride constituent in the tool or by use of other tool additives, but these attempts have not increased the tool life significantly as the tool life is controlled by the mechanism of chemical wear.

Currently, silicon nitride tools and SiAlON, a ceramic tool based on a quaternary system involving Si-O-Al-N, are most extensively used for machining cast iron. These tools are very cheap in relation to cubic boron nitride tools. If these tools are applied for finish machining cast iron at high speeds and low feed rates, the tool life is again unpredictable for the same reason i.e., chemical wear.

Extensive research has been carried out over the years but a quantitative understanding of the mechanism underlying chemical wear has not been established. Previous studies have focused on foundry practice variables including melting methods, charge materials, inoculation, pouring variables, cooling cycles and cleaning processes. The variables affecting the chemical wear at the cutting edge of the tool, however, have not been isolated. A transition from chemical to abrasive wear on PCBN tools was reported with increased feed rate. Unfortunately, when the feed rate is increased, surface finish on the workpiece deteriorates dramatically. Thus, it is essential to identify the critical variables that control the mechanism of chemical wear occurring at low feed rates in high speed finish machining in order to take corrective measures. Routine metallurgical investigations on castings drawn from batches that machined well in comparison with those that gave poor tool life did not reveal any clues. Statistical approaches based on multi-variants involving machining variables and foundry variables did not resolve the problem as the key parameters relating to solute concentrations of reactive elements, which control the mechanism of chemical wear, were not taken into account.

Accordingly, it is an object of this invention to provide processes which minimize chemical wear at the cutting edge of nitride tools such as cubic boron nitride, silicon nitride, SiAlON, and the like, during high speed machining of gray cast iron in order to achieve consistently good surface finish coupled with prolonged tool life.

It is a further object of this invention to provide improved gray cast irons, which can undergo high speed machining with cubic boron nitride tools while preserving the cutting edge and useful life of such tools.

It is a still further object of this invention to provide improved gray cast irons, which retard chemical wear at the cutting edge of the tool during high speed machining with cutting tools such as cubic boron nitride, silicon nitride or SiAlON.

SUMMARY OF THE INVENTION

The foregoing objects as well as other objects and advantages are accomplished by the present invention which comprises a process for producing gray cast iron exhibiting consistently good surface finish with prolonged tool life during finish machining comprising: i) forming a near—eutectic or eutectic melt which upon solidification gives A-type graphite flakes in a pearlitic matrix; ii) adding microalloying elements with strong affinity for nitrogen and carbon to said gray iron melt to combine with dissolved nitrogen and carbon in said iron matrix; iii) adding elements with strong affinity for oxygen to said melt adapted to form a chemically stable, high melting or refractory oxide protective layer on the surface of the tool in contact with said cast iron during finish machining; and iv) inoculating the melt with ferrosilicon based additives, and casting the resulting melt.

This invention is directed to the substantive elimination of the localized chemical wear at the cutting edge of the tool occurring at the high speeds and low feed rates characteristic of finish machining of cast iron. I have now discovered that the oxidation of the cutting tool which occurs at the cutting edge of the cubic boron nitride tool and the silicon nitride tool, respectively, is caused by high temperature due to shear localization in the primary shear zone. The temperature increase is brought about by strength increase in the cast iron due to strain aging. In accordance with my invention, decreased temperature at the cutting edge of the tool can be achieved by preventing strength increase in the cast iron due to strain aging. Strain aging is caused predominantly by interstitial solutes, namely nitrogen and carbon, dissolved in the iron matrix. Scavenging the nitrogen with, for example, titanium as titanium nitride, eliminates dynamic strain aging due to solute nitrogen. By the same token, scavenging the carbon in ferrite with, for example, vanadium as vanadium carbide, eliminates dynamic strain aging due to solute carbon in ferrite. I have discovered that it is possible to keep vanadium in solution in austenite prior to eutectoid transformation because the solubility of vanadium in austenite is increased by carbon in a high carbon austenitic matrix. Chemical wear is caused by oxidation of the cutting edge of the tool due to high temperature. Cubic boron nitride tools are unstable in the presence of oxygen in air and hence readily oxidize forming low melting $B_2O_3$. According to the present invention, the tool surface is protected from chemical oxidation by adding reactive elements such as Al to the cast iron matrix, thereby forming a stable refractory $Al_2O_3$ layer that protects the cutting edge of the tool by reducing $B_2O_3$.

At high cutting speeds, shear localization in the primary shear zone raises the temperature of the cutting edge of the tool. Just like cubic boron nitride tools, silicon nitride tools are unstable in the presence of oxygen in air at high temperature and hence readily oxidize forming silica glass. If a stable refractory oxide can be formed through microalloying addition of elements with strong affinity for oxygen to the gray cast iron workpiece, the tool life can be enhanced substantially. Just as in the case of cubic boron nitride tools, soluble aluminum in the iron matrix in workpiece can reduce silica in-situ to form a more stable refractory oxide enriched in alumina that can preserve the cutting edge of the tool. Thus tool life can be extended by in-situ reaction between a reactive element engineered into the work piece and the unstable oxide formed at the cutting edge of the tool. The reactive element such as aluminum reduces the oxide layer formed on the tool surface and forms a more stable refractory oxide that protects the cutting edge of the tool.

DESCRIPTION OF THE PREFERRED EMBODIMENTS

Figure 1:
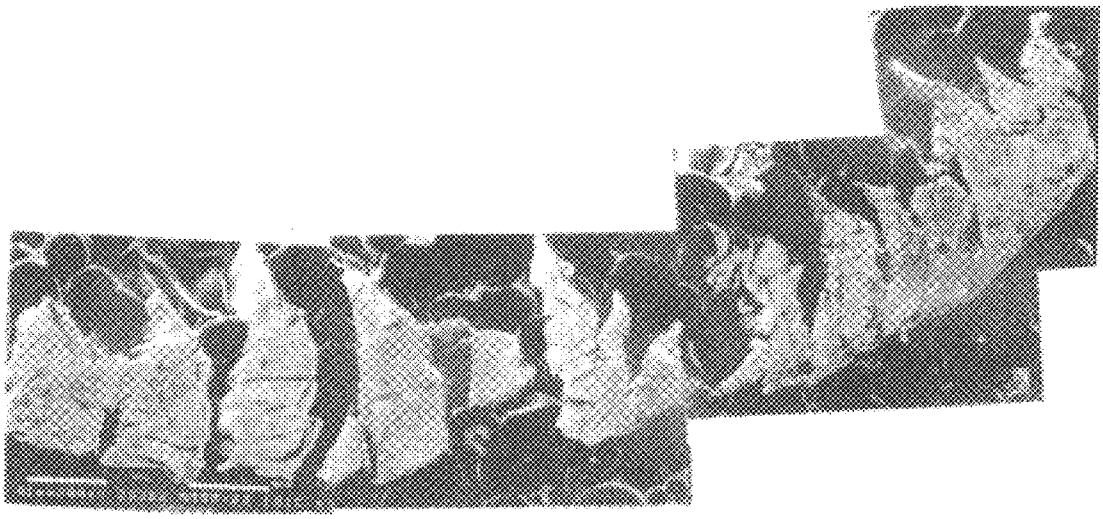
FIG. 1 is an optical micrograph of a polished section of a typical chip obtained in a high speed finish machining of gray cast iron at a high cutting speed of 7,200 feet (2,194 m) per minute and a feed rate of 0.006 inch (0.15 mm) per revolution. The chip mounted in Bakelite resin shows fully segmented chip morphology. The dark long A-type graphite flakes are distributed randomly in the bright iron matrix. The segmentation of the chip is due to localization of shear in the primary shear zone. The consequent temperature rise accelerates chemical wear at the cutting edge of the tool.
Figure 2A:
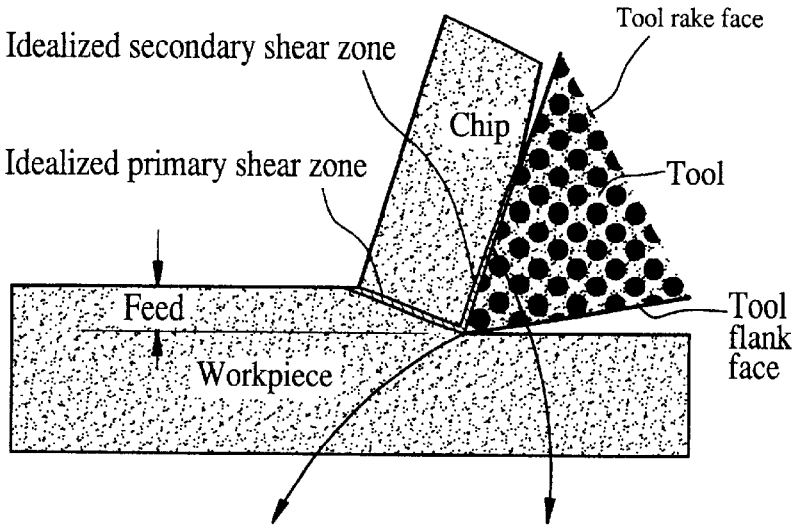
FIG. 2*a* is a schematic representation of the primary and secondary shear zones, occurring in the chip during metal cutting.
Figure 2B:
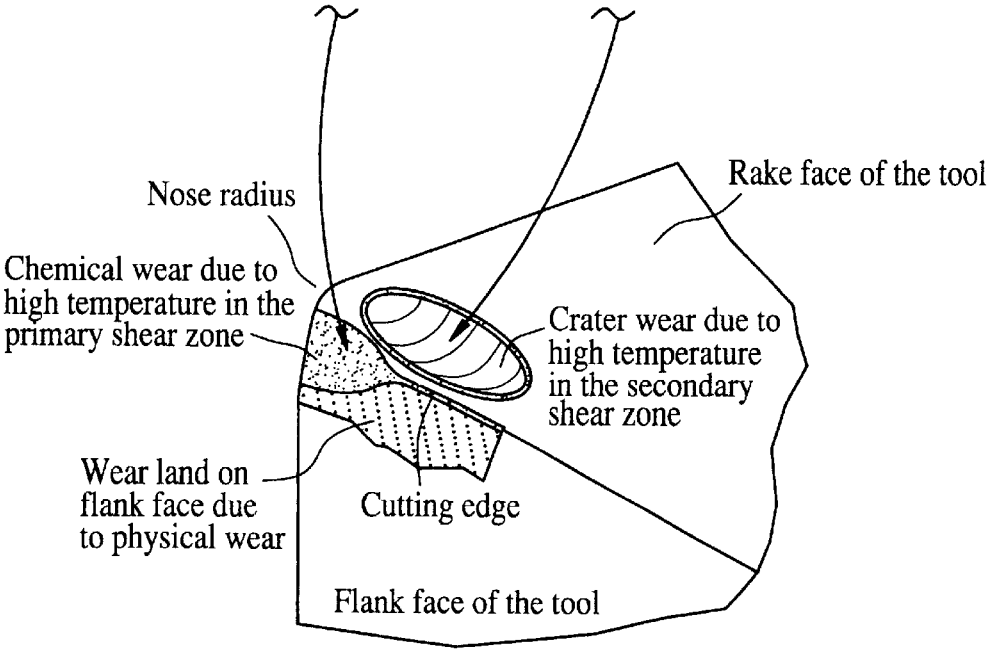
FIG. 2*b* is a schematic representation of tool wear caused by shear localization in the chip during metal cutting. Temperature rise caused by shear localization in the primary shear zone localizes the chemical wear at the cutting edge of the tool. Temperature rise in the secondary shear zone caused by seizure at the tool-chip interface localizes the crater wear at some distance from the cutting edge of the tool.

FIG. 1 is an optical micrograph of a polished section of a typical chip obtained in high speed finish machining of gray cast iron at a high cutting speed of 7,200 feet (2,194 m) per minute and a feed rate of 0.006 inch (0.15 mm) per revolution. The chip morphology is fully segmented. The microstructure exhibits features characteristic of nonhomogeneous deformation caused by shear localization in the primary shear zone, leading to fracture or segmentation of the chip. Shear localization in chips occurring due to large strain, high strain rate deformation characteristic of metal cutting, and the consequence of shear localization in the primary and secondary shear zones on tool wear are schematically illustrated in FIGS. 2*a* and 2*b*, respectively. The consequence of high temperature due to shear localization in the primary shear zone is chemical wear at the cutting edge of the tool. By contrast, the consequence of high temperature due to shear localization in the secondary shear zone is chemical crater wear on the rake face of the tool, located at some distance away from the cutting edge of the tool. The segmentation of the chip is due to shear localization in the primary shear zone.

Shear localization in metal cutting is caused by thermal softening due to a hardened metal matrix or geometric softening due to second phase particles dispersed in the matrix. During the large strain, high strain rate deformation that occurs in the cutting process, the incompatibility of deformation between the metal matrix and the long interconnected graphite flakes causes void nucleation and growth preferentially along the graphite-metal interface. This results in shear localization in the primary shear zone caused by geometrical softening due to second phase particles. Once shear localization occurs, be it by thermal or geometric softening, the work of deformation is localized in a narrow region, when the bulk (85–95%) of the work due to plastic deformation of metal converts into heat. At high strain rates characteristic of high cutting speeds, there is inadequate time for the heat to escape from the shear zone, which results in local temperature rise in the primary shear zone.

An important consequence of shear localization at high strain rate deformation is steep temperature rise in the primary shear band irrespective of whether shear localization is caused by thermal softening due to a hardened matrix or geometric softening due to second phase particles. In experimental investigation on hardened iron-nickel alloys, it has been discovered that the interaction of the transformation shear band at high temperature with the cutting edge of the tool causes chemical wear at the cutting edge of the tool.

Figure 3A:
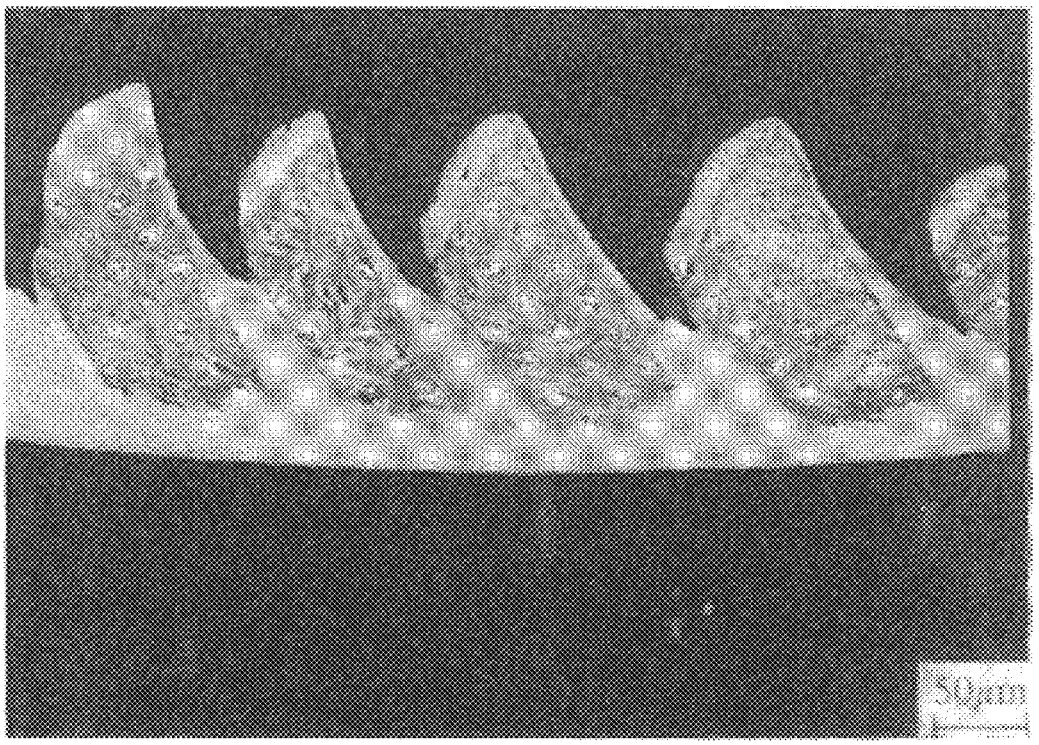
FIG. 3*a* is an optical micrograph of a shear localized chip obtained from cutting Fe-29% Ni-0.1% C alloy in the hardened (martensitic) condition at a cutting speed of 1,496 feet (456 m) per minute and a feed rate of 0.01"(0.25 mm) per revolution. The white regions have undergone phase transformation from martensite to austenite due to high temperature caused by shear localization in the primary and secondary shear zones.
Figure 3B:
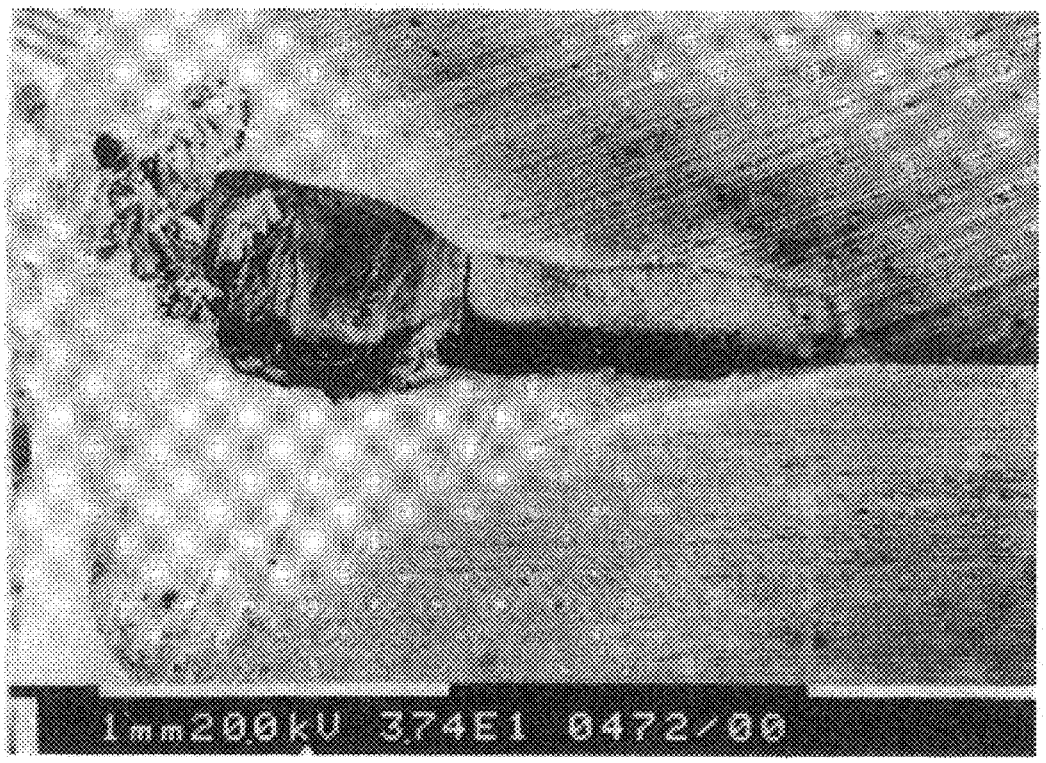
FIG. 3*b* is a SEM picture of a cemented carbide tool showing localization of wear at the cutting edge of the tool after machining for 30 seconds at a cutting speed of 1,496 feet (456 m) per minute and a feed rate of 0.01" (0.25 mm) per revolution. The high temperature due to shear localization in the primary shear zone has caused chemical wear at the cutting edge of the tool.

FIG. 3*a* is an optical micrograph of a typical chip and FIG. 3*b* is a SEM picture of the resulting tool wear obtained from cutting a fully hardened Fe-29%Ni-0.1% C alloy for 30 seconds at a cutting speed of 1,496 feet (456 m) per minute and a feed rate of 0.006" (0.15 mm) per revolution. FIG. 3*a* is an optical micrograph of a shear localized chip obtained from cutting Fe-29% Ni-0.1% C alloy in the hardened (martensitic) condition exhibiting microstructural change (white region) associated with phase transformation (to austenite) due to high temperature caused by shear localization in the primary and secondary shear zone. FIG. 3*b* is a SEM picture of a cemented carbide tool showing localization of wear at the cutting edge of the tool. The high temperature due to shear localization in the primary shear zone causes chemical wear at the cutting edge of the tool.

Figure 4:
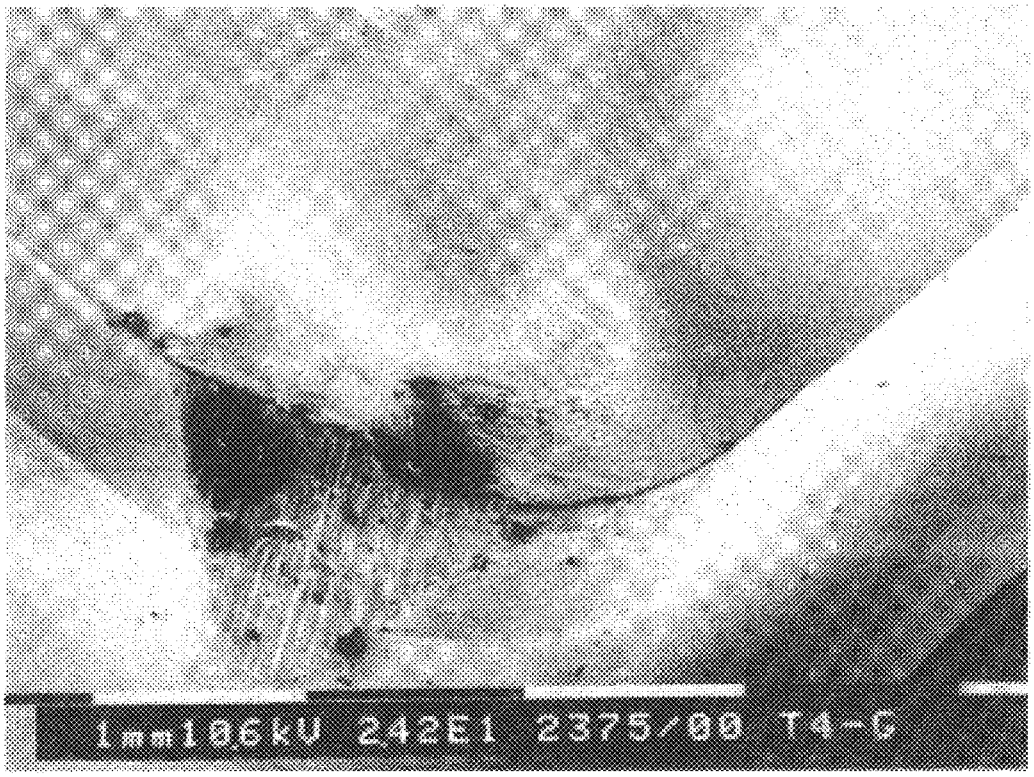
FIG. 4 is a SEM picture of typical wear obtained during high speed machining of gray cast iron with a cubic boron nitride tool at 7,200 feet (2,194 m) per minute and a feed rate of 0.006"(0.15 mm) per revolution. The wear localized at the cutting edge of the tool is chemical in origin and is caused by high temperature arising from shear localization in the primary shear zone.

FIG. 4 is a picture of typical wear obtained during high speed machining of gray cast iron with a cubic boron nitride tool at 7,200 feet (2,194 m) per minute at a feed of 0.006"(0.15 mm) per revolution. Since the wear extends well into the flank face of the tool, the origin of the wear was mistaken in the past for physical wear processes, caused by hard abrasive particles. Diffusional penetration of elements from the gray iron workpiece into the cutting edge of the tool was confirmed by experimental investigation. The depth profile of the concentration of elements was characterized on the tool surface using secondary ion mass spectrometry. The results confirmed that the wear mechanism at high speed and low feed rates is chemical in origin.

A direct consequence of the loss of cutting edge by tool wear is the loss of surface finish of the workpiece. A component, such as a brake rotor, machined from a casting has to meet a target surface finish specification as dictated by product performance. For example, in brake rotors, the requirement is a median surface finish (Ra) of less than one micrometer. Therefore, it is imperative to achieve an optimum tool life based on an adequate number of castings machined per tool with acceptable surface finish in order to justify the high cost of a cubic boron nitride tool. However, unknown variables in castings are found to decrease the tool life in an unpredictable manner, which have rendered the control of the technology difficult and the process of high speed finish machining uneconomical. Thus, it is another object of this invention to identify the mechanism causing tool wear, and to prevent the wear at the cutting edge of the tool during high speed machining in order to achieve consistently good surface finish over a prolonged tool life. It is a still further object of the invention to provide a gray cast iron that minimizes chemical wear at the cutting edge of the tool during high speed machining with cubic boron nitride and silicon nitride cutting tools.

The present invention is discussed in detail below with reference to its underlying concepts.

(1) Dynamic strain aging is caused by solute or free nitrogen in the iron matrix, which increases flow stress of the workpiece material and raises the temperature at the cutting edge of the tool causing chemical wear. Dynamic strain aging due to solute nitrogen can be prevented in accordance with the present invention by combining the free or solute nitrogen with microalloying elements, which have strong affinity for nitrogen, selected from the group consisting of Ti, Zr, Hf, Nb, Al, Ce, V, Sr, Ta and mixtures thereof in order to form stable chemical compounds (nitrides) therewith. These nitrides are designed to precipitate in the high temperature range in austenite prior to phase transformation (>713° C.) so that they do not dissolve at metal cutting temperatures.

(2) Carbon in solution in ferrite also has been found to cause strain aging. It has now been discovered that microalloying elements selected from the group consisting of V, Nb, Ta, Zr, Ti, and mixtures thereof are retained in solution in high carbon austenite, which, upon transformation to ferrite (≦713° C.), combine with carbon to form carbides, thus decreasing the strain aging effect due to carbon.

(3) Chemical oxidation of BN to $B_2O_3$ or $Si_3N_4$ to $SiO_2$, for example, accelerates the chemical diffusional wear of the nitride cutting tools. According to the present invention, chemical wear of the tool can be prevented by adding elements with greater affinity for oxygen than that of boron or silicon into the gray cast iron workpiece, said elements being selected from the group consisting of Al, Ce, Ca, Mg, Ti, Sr, Zr, and mixtures thereof. These elements should be present as solute that is uncombined in the iron matrix so that they can react in-situ with the $B_2O_3$ or $SiO_2$ layer on the tool surface to form stable refractory oxides such as alumina, which protect the cutting edge of the tool from chemical wear by oxidation.

It is essential to tie up the bulk of the nitrogen in the iron matrix with an element such as titanium, which has a greater affinity for nitrogen than other elements which, while having an affinity for nitrogen may also have an affinity for oxygen, such as aluminum. The removal of solute nitrogen from the iron matrix at high temperature as TiN precipitate eliminates dynamic strain aging from solute nitrogen. Such a step equally ensures that the microalloying addition of an element which has a strong affinity for oxygen and also has a strong affinity for nitrogen, such as aluminum, is fully available for reaction in-situ with any unstable oxide ($B_2O_3$, $SiO_2$,) layer formed on the cutting edge of the tool due to high temperature oxidation during metal cutting.

The present invention is explained in more detail with reference to the mechanism of chemical wear and the novel concept of altering the composition of the workpiece to form a protective layer on the cutting surface of the tool by chemical reaction therewith to thereby prevent chemical wear of the tool.

This invention is based on the discovery that when chip segmentation occurs at high strain rates characteristic of high cutting speeds, shear localization in the primary shear zone raises the local temperature within the shear band in the primary shear zone. Dynamic strain aging increases the shear flow stress of the workpiece material which, in turn, increases the temperature in the primary shear band once shear localization sets in. The interaction of the shear band with the cutting edge of the tool, in turn, raises the temperature at the cutting edge of the tool, whereby severe oxidation of the cutting edge of the tool occurs. This is consistent with thermodynamic analysis, which shows that there is a large driving force, for example, for cubic boron nitride to become oxidized to $B_2O_3$ at high temperature in air.

$$2(BN)_{tool}+1.5\{O_2\}_{atmosphere}=\{N_2\}_{interface}+(B_2O_3)_{interface} \quad (1)$$

$$\log k = \log\left(\frac{P_{N_2}\cdot a_{B_2O_3}}{P_{O_2}^{1.5}\cdot a_{BN}^2}\right) = \frac{38126}{T} - 1.66$$

T=1173 K (900° C.), $k=7\times10^{30}$, where $a_i$ denotes the Roultian activity of the oxide or nitride component i, the pure compound is the reference state of unit activity, and $P_i$ denotes partial pressure of the component, in the gas phase. Thus, when the tool surface at high temperature is exposed to air, there is a strong thermodynamic driving force to oxidize BN to $B_2O_3$.

The $B_2O_3$ layer is liquid at the tool-chip interface temperature because the melting point of pure $B_2O_3$ is very low (470° C.). The $B_2O_3$ layer is very fluid ($10^3$ poise) at 900° C. The kinetics of diffusional chemical wear is large at high cutting speeds driven by the high diffusivity of oxygen in the liquid phase. Binary compounds involving $B_2O_3$ and $SiO_2$ are low melting oxides, in which the diffusivity of oxygen is still high, which results in accelerated diffusional wear.

The invention is based on the novel concept of reduction of $B_2O_3$ at the tool surface through addition of soluble aluminum or other elements with strong affinity for oxygen in the iron matrix so that a stable $Al_2O_3$ layer is formed on the tool cutting surface by in-situ reaction at the tool-chip interface.

$$(\tfrac{1}{2})(B_2O_3)_{interface}+[Al]_{workpiece}=(\tfrac{1}{2})(Al_2O_3)_{interface}+(B)_{interface} \quad (2)$$

$$\log k = \log\left(\frac{a_{Al_2O_3}^{1/2}\cdot a_B}{a_{B_2O_3}^{1/2}\cdot h_{Al}}\right) = \frac{7320}{T} - 3.075$$

T=1173 K (900° C.), k=1463.

where h denotes Henrian activity of the component in metal phase in dilute solution, the one weight per cent of the component in solution in iron is taken as the reference state of unit Henrian activity of the component.

The analysis shows that in order to form a protective layer of $Al_2O_3$ within 5 seconds, the required soluble aluminum in the matrix is 30 ppm. Such a low concentration of soluble aluminum can advantageously be introduced to the melt by slag metal equilibration. The formation of alumina film at the tool-chip interface by the reduction of liquid $B_2O_3$ will reduce the diffusional chemical wear by several orders of magnitude.

Thus, the improved cast iron of the present invention is based, in part, on ensuring an adequate soluble aluminum (or comparable element having a strong affinity for oxygen) content therein for in-situ reaction with oxygen, $B_2O_3$ or $SiO_2$ to form a stable, $Al_2O_3$-rich protective layer on the tool cutting surface. It should be noted that there are other strong deoxidants, which exhibit large negative free energy of oxide formation comparable to aluminum. Thus, members selected from the group consisting of Al, Ca, Ce, Zr, Mg, Ti, Sr, Zr, and mixtures thereof will form stable, refractory oxides. These elements can be substituted for Al either singly or in combination to ensure the formation of stable oxides that can protect the cutting edge of the tool in high speed machining by those skilled in the art. The use of these elements in the cast iron of the present invention to reduce $B_2O_3$ or $SiO_2$ to form a stable, protective layer by in-situ reaction to minimize chemical wear of the tool is considered a novel aspect of this invention.

If a $Si_3N_4$ tool is used instead of PCBN, the temperature rise at the cutting edge of the tool due to shear localization in the primary shear zone will cause oxidation of the cutting edge of the tool in the presence of air. Thermodynamic analysis shows that the formation of $SiO_2$ is favorable at 900° C. according to Equation 3. Since the melting point of pure $SiO_2$ is high (1725° C.), the situation is not as bad as compared to $B_2O_3$. If adequate soluble Al (or a comparable element having high affinity for oxygen) is introduced into the matrix, the formation of an alumina rich layer is predicted from Equation 4, which will enhance the tool life.

$$(\tfrac{1}{3})(Si_3N_4)_{tool}+\{O_2\}_{atmosphere}=(\tfrac{2}{3})\{N_2\}_{interface}+(SiO_2)_{interface} \quad (3)$$

$$\log k = \log\left(\frac{P_{N_2}^{2/3}\cdot a_{SiO_2}}{P_{O_2}\cdot a_{Si_3N_4}^{1/3}}\right) = \frac{34230}{T} - 0.42\log T - 2.055$$

T=1173 K (900° C.), k=$6.9\times10^{25}$.

$$(SiO_2)_{interface}+(\tfrac{4}{3})[Al]_{workpiece}=(\tfrac{2}{3})(Al_2O_3)_{interface}+(Si)_{interface} \quad (4)$$

$$\log k = \log\left(\frac{a_{Al_2O_3}^{1/2}\cdot a_{Si}}{a_{SiO_2}\cdot h_{Al}^{4/3}}\right) = \frac{7600}{T} + 0.55\log T - 6.31$$

T=1173 K (900° C.), k=72.

The following examples further illustrate the present invention. These examples are included solely for the purpose of illustration and should not be construed in limitation of the present invention. All percentages and parts are by weight unless otherwise specified.

EXAMPLES

Example I

Gray iron castings from one production batch labeled Heat-A were machined at a low feed rate of 0.006" per revolution and high cutting speed of 7,200 feet per minute using a cubic boron nitride tool. The type of insert used is cubic boron nitride insert: Valenite CBN VC 722 BSNG-434 (Valenite Polycrystalline Products available from Valenite, 31100, Stephenson Highway, Madison Heights, Mich., MI 48071, U.S.A.). The tool geometry is tool nose radius 0.062", depth of cut: 0.020". The cutting geometry: Radial Rake −9°, Axial Rake −5°.

The cutting edge of the tool was preserved and consequently, a consistent surface finish of 0.5 to 0.9 micrometer was obtained after machining over 300 castings, with no apparent flank wear at the cutting edge of the tool. The total nitrogen content of the iron ranged between 0.005 to 0.0055 wt %. A high titanium content of the melt in the holding furnace (0.029 wt %) and a relatively low melt temperature of the holding furnace (1440° C.) were employed, which could account for the low nitrogen analysis obtained in this case. Under normal production conditions, the nitrogen content of a cast iron melt is typically in the range of about 0.006 to 0.008 wt %.

The cast iron melt was inoculated with standard grade ferro-silicon, in which the silicon content normally ranges from about 45 to 79%. The microalloying elements were carried in the ferro-silicon based inoculants, which are commercially available. But these invariably contain low silicon content. The grading of the inoculant used is typically 20 mesh by 70 mesh, a maximum of 15% below 70 mesh screen and 5% above 30 mesh. The amount of inoculant is typically 0.15–0.4 wt % of the melt pouring weight. The inoculant was dispensed into the melt stream during pouring of the iron into the green sand mold by the well-known in-stream inoculation process. Increased inoculant addition is required to compensate for the fading of the inoculation effect particularly in the case of ladle inoculation where longer holding time may occur subsequent to inoculation.

The matrix microstructure was mostly (95%) pearlitic and the graphite morphology was predominantly Type-A with some B and C, the graphite size being 3-4 according to ASTM A247, Plates II & III classification.

Figure 6:
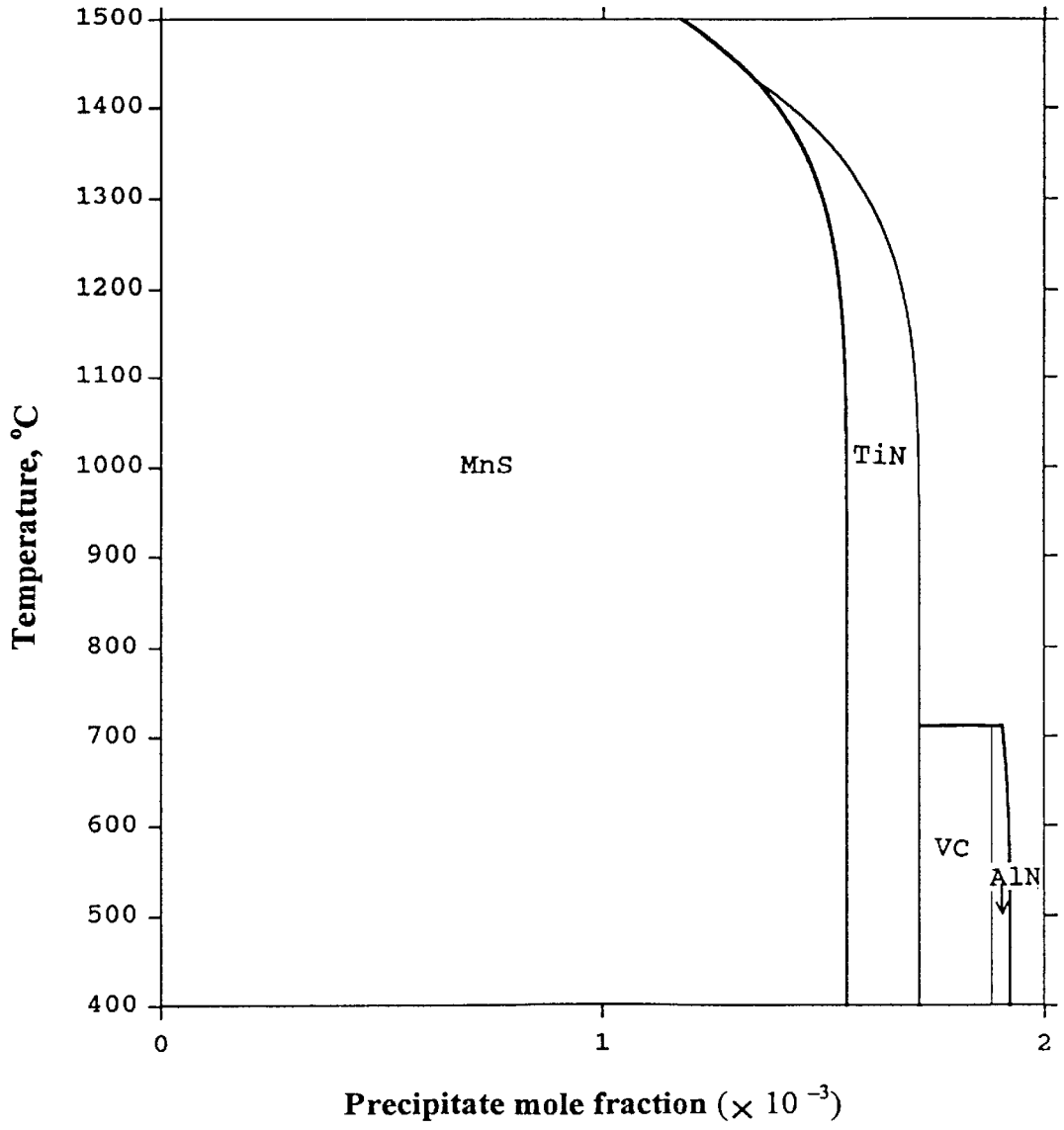
FIG. 6 is an equilibrium precipitation diagram for the base chemistry of Heat-A, which shows equilibrium precipitate mole fraction as a function of temperature in a fully pearlitic iron matrix. The sequence of precipitation is MnS and TiN in austenite and VC and AlN upon phase transformation at 713° C.

The base chemistry of Heat-A is summarized in Table-1. Thermodynamic analysis of the precipitation behavior of the base chemistry of the casting is summarized in FIG. 6, which shows equilibrium mole fraction of the precipitate as a function of temperature.

The following is the sequence of precipitation: MnS, TiN precipitating in austenite phase followed by VC and AlN in ferrite upon phase transformation from austenite to ferrite. Almost all the titanium is consumed to tie up as much as 0.004 wt % nitrogen as TiN precipitate in high temperature in austenite, leaving a balance of 0.0015 wt % N in austenite. Eutectoid transformation occurs at about 713° C., when austenite transforms to pearlitic microstructure made up of ferrite and cementite phases. Upon eutectoid phase transformation, there is thermodynamic potential for precipitation of VC and AlN respectively, because of the steep decrease in solubility product of VC and AlN in ferrite. All the balance of the nitrogen (0.0015 wt %) is scavenged by soluble aluminum in the matrix from ferrite as AlN. Thus, the bulk of the nitrogen is removed from solution in the iron matrix as TiN and AlN precipitates so that dynamic strain aging due to dissolved nitrogen is completely eliminated in this case. The precipitation of VC in ferrite is beneficial in that it decreases the strain aging potential due to carbon. If V were to remain in solution because of the kinetic problem due to nucleation, the diffusive mobility of carbon atoms is retarded due to interaction with solute vanadium, which has the net effect of retarding strain aging due to carbon. More importantly, when the temperature at the cutting edge exceeds the phase transformation temperature of 713° C., the AlN will dissolve back in the iron matrix, reverting Al and N in solution in the iron matrix.

Solute Al and N in the iron matrix will react with $B_2O_3$ in-situ on the tool to form $Al_2O_3$ and BN at the interface, thus suppressing chemical wear. Long wavelength X-ray signals detected from scanning electron microscopic examination of the cutting edge of the tool showed large intensity of signals for B and N, indicative of the preservation of the cutting edge of the cubic boron nitride tool.

Figure 5:
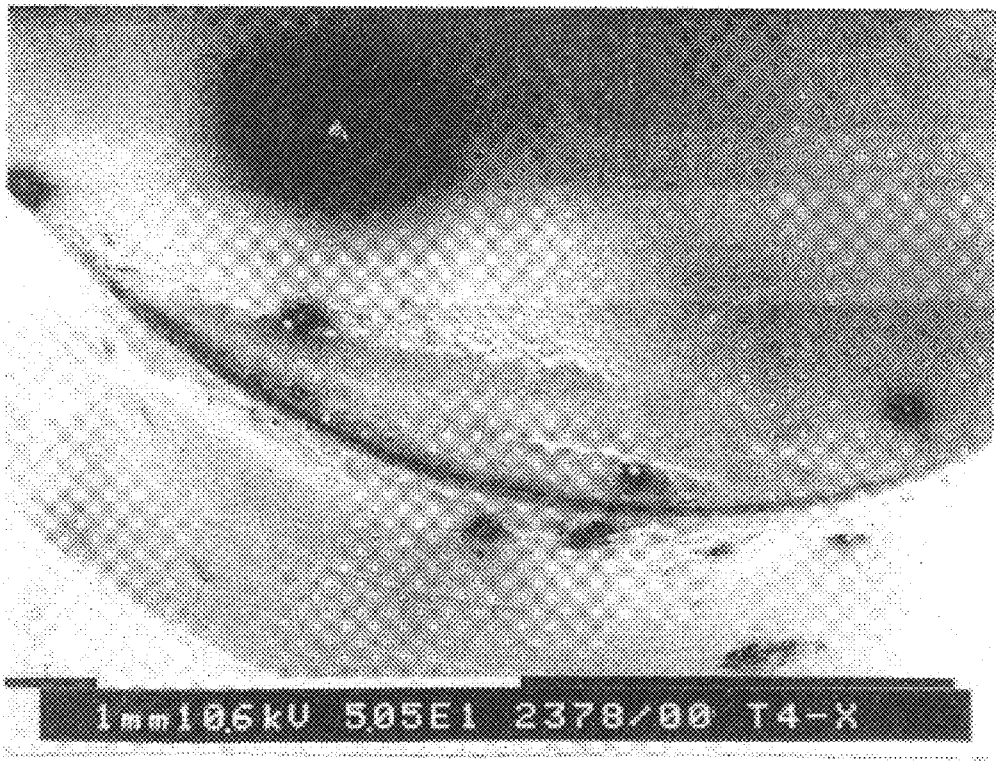
FIG. 5 is a SEM picture of the cubic boron nitride tool after machining 300 pieces of casting at a cutting speed of 7,200 feet (2,194 m) per minute at a feed rate of 0.006" (0.15 mm) per revolution. The cutting edge of the tool is well preserved by a protective layer formed on the tool surface by tool-workpiece interaction.

FIG. 5 is a SEM picture of the cubic boron nitride tool after machining 300 pieces of casting at a cutting speed of 7,200 feet (2,194 m) per minute at a feed rate of 0.006"(0.15 mm) per revolution. The cutting edge of the tool was well preserved even after machining 300 pieces and hence the surface finish obtained was consistently good.

Comparative Example II

Gray cast iron castings from several other production batches that exhibited poor machinability were subjected to metallurgical investigation. Gray iron castings from a production batch labeled Heat-B are analyzed below as representative of the several batches which gave poor tool life and surface finish.

The castings from Heat-B were subjected to finish machining trials at a low feed rate of 0.006" (0.15 mm) per revolution and high cutting speed of 7,200 feet (2,194 m) per minute using a cubic boron nitride tool. The type of insert and the tool geometry are as detailed in Example-1. The cutting edge of the tool exhibited severe wear immediately after the start of machining, which is reported as gross flank wear. The tool life was limited to less than 10 castings based on the target median surface finish (Ra) of 1 micrometer.

The matrix microstructure was mostly (95%) pearlitic and the graphite morphology was predominantly Type-A with some B and C, the graphite size being 3-4 according to the ASTM classification cited in Example I.

The base chemistry of the castings from Heat-B is summarized in Table 1. The equilibrium predictions of solute concentrations (wt %) of Ti, N and Al in the iron matrix as a function of temperature for Heat-A and Heat-B are summarized in Table 2. Heat B contained a higher nitrogen content of 0.0077 wt %, lower titanium content of 0.008 wt %, and lower aluminum content of 0.001 wt % than the castings from Heat-A.

According to thermodynamic analysis of the precipitation behavior of the casting from Heat-B, the following is the sequence of precipitation: MnS, TiN precipitating in austenite phase followed by AlN in ferrite upon phase transformation from austenite to ferrite. Almost all the titanium is consumed to tie up as much as 0.0023wt % nitrogen as TiN precipitate in high temperature in austenite, leaving a balance of 0.0054 wt % N in austenite. At 713° C., eutectoid transformation occurs when austenite transforms to pearlite. The precipitation of AlN starts upon eutectoid transformation, when Al combines with about 0.0005 wt % N to form AlN, thus leaving as much as 0.0049 wt % of nitrogen as dissolved in the iron matrix. The presence of such a large amount of solute nitrogen causes dynamic strain aging, which in turn increases the shear flow stress and hence the temperature at the cutting edge of the tool. At high temperature brought about by dynamic strain aging, chemical wear is accelerated. The amount of soluble aluminum available in Heat-B is smaller than in Heat-A and is inadequate to counteract the diffusional chemical wear through protective layer formation.

FIG. 4 shows localization of severe wear at the cutting edge of the tool after machining 10 pieces of casting. The loss of cutting edge of the tool is caused by chemical wear, resulting in the loss of surface finish.

TABLE 1

| | Chemical analysis | | | | | | | | | | | | |
|---|---|---|---|---|---|---|---|---|---|---|---|---|---|
| Heat | Ce | C | Mn | P | S | Si | Ni | Cr | Cu | Al | Ti | V | N |
| A | 4.2 | 3.42 | 0.577 | 0.063 | 0.089 | 2.27 | 0.077 | 0.22 | 0.121 | 0.002 | 0.014 | 0.015 | 0.0055 |
| B | 4.13 | 3.38 | 0.577 | 0.036 | 0.082 | 2.2 | 0.037 | 0.105 | 0.085 | 0.001 | 0.008 | 0.0 | 0.0077 |

TABLE 2

Equilibrium prediction of solute concentration (wt %) of Ti, N and Al in iron matrix as a function of temperature

| Temperature | Solute Ti, wt % | | Solute N, wt % | | Solute Al, wt % | |
|---|---|---|---|---|---|---|
| ° C. | Heat-A | Heat-B | Heat-A | Heat-B | Heat-A | Heat-B |
| 900 | 0 | 0 | 0.0014 | 0.0054 | 0.002 | 0.001 |
| 800 | 0 | 0 | 0.0014 | 0.0054 | 0.002 | 0.001 |
| 700 | 0 | 0 | 0.0005 | 0.0049 | 0.0005 | 0.00012 |

Ferro-silicon can be used to nucleate graphite from the melt. According to the present invention, microalloying additions of elements with strong affinity for nitrogen dissolved in the austenitic iron matrix, elements with strong affinity for solute carbon in the ferritic iron matrix and elements with strong affinity for oxygen in iron are required. The first two additions serve to scavenge the dissolved nitrogen and carbon which otherwise will cause dynamic strain aging, increasing the flow stress of iron and consequently effecting a temperature rise at the cutting edge of the tool. Dynamic strain aging can be preempted by static strain aging or by subcritical annealing. Under these conditions, microalloying addition of elements with strong affinity for oxygen is required to form in-situ a stable refractory oxide to preserve the cutting edge of the tool.

It is also possible to eliminate the microalloying addition to tie up the carbon in the ferritic matrix, but with microalloying additions to tie up dissolved nitrogen and reduce the unstable oxide at the cutting edge of the tool to form in-situ a stable refractory oxide, which preserves the cutting edge of the tool. In this case, carbon can be tied up as iron carbide either by relatively slow cooling or through use of a subcritical annealing schedule.

Still further, it is possible to eliminate the microalloying additions to tie up the nitrogen in austenite and carbon in ferritic matrix, but with microalloying additions to reduce the unstable oxide at the cutting edge of the tool to form in-situ a stable refractory oxide, which preserves the cutting edge of the tool. In this case, nitrogen can be tied up as iron nitride and carbon can be tied up as iron carbide either by relatively slow cooling or through use of a subcritical annealing schedule.

While the invention has been particularly shown and described with reference to various embodiments, it will be understood by those skilled in the art that modifications and changes may be made to the present invention without departing from its scope.

What is claimed is:

1. A gray cast iron adapted to impart prolonged tool life during finish machining to a nitride tool, comprising: cast iron having a near eutectic or eutectic melting point and having A-type graphite flakes in a predominantly pearlitic matrix obtained by inoculation with ferro-silicon additives to the melt; said cast iron further comprising one or more alloying elements having a stronger affinity for oxygen than B or Si in said nitride tool, said alloying elements being dissolved in the iron matrix and present in uncombined elemental form in the cast iron, which, during subsequent machining operations using said nitride tool, will combine with oxygen.

2. The gray cast iron of claim 1, wherein said alloying elements form in-situ at the cutting edge of the tool a stable refractory oxide layer by combining with oxygen during said machining operation, thereby reducing any unstable oxides of $B_2O_3$ or $SiO_2$ on the tool surface and preventing the oxidation wear of the nitride tool.

3. The gray cast iron of claim 1 further comprising alloying elements which combine with nitrogen to form nitrides in the iron matrix by reacting with the nitrogen in the cast iron in austenite before the completion of transformation of austenite to pearlite during the cooling of the casting, thereby preventing high temperatures at the cutting edge of the tool and avoiding accelerated tool wear.

4. The gray cast iron of claim 1 further comprising alloying elements which combine with carbon to tie up all soluble carbon in ferrite in the form of carbides so that the dynamic strain aging due to free carbon in ferrite or pearlitic ferrite is avoided in subsequent machining operations, thereby preventing high temperatures at the cutting edge of the tool and avoiding accelerated tool wear.

5. The gray cast iron of claim 1, wherein said alloying elements with a stronger affinity for oxygen than B or Si are selected from the group consisting of Al, Ce, Ca, Mg, Ti, Sr, Zr and mixtures thereof.

6. The gray cast iron of claim 3, wherein said alloying elements which combine with nitrogen are selected from the group consisting of Ti, Zr, Hf, Nb, Al, Ce, V, Sr, Ta and mixtures thereof.

7. The gray cast iron of claim 4, wherein the alloying elements which combine with carbon to remove soluble carbon in ferrite as carbides in the iron matrix are selected from the group consisting of V, Nb, Ta, Zr, Ti and mixtures thereof.

8. The gray cast iron of claim 3, wherein the alloying element is aluminum in an amount such that the soluble aluminum content that is uncombined in the iron matrix at room temperature in the casting ranges from about 0.002 to 0.01 wt %.

9. The gray cast iron of claim 1, wherein the iron has a near-eutectic composition comprising about 3.0 to 4.5% by weight carbon; about 1.0 to 3.5% by weight silicon; up to about 0.8% by weight manganese; about 0.05 to 0.15 wt % sulfur; and less than about 0.1% by weight phosphorus.

10. The gray cast iron of claim 1, wherein the dynamic strain aging due to nitrogen and carbon is minimized by subcritical annealing, static aging or slow cooling of the casting.

* * * * *